US006285772B1

(12) United States Patent
Tate et al.

(10) Patent No.: US 6,285,772 B1
(45) Date of Patent: Sep. 4, 2001

(54) NOISE CONTROL DEVICE

(75) Inventors: Joseph B. Tate, Sausalito; Steven B. Wolff, Woodacre; Vidya Sagar Rao, San Ramon, all of CA (US)

(73) Assignee: UmeVoice, Inc., Novato, CA (US)

( * ) Notice: Subject to any disclaimer, the term of this patent is extended or adjusted under 35 U.S.C. 154(b) by 0 days.

(21) Appl. No.: 09/357,668

(22) Filed: Jul. 20, 1999

(51) Int. Cl.[7] ..... H04R 25/00

(52) U.S. Cl. ..... 381/357; 381/355; 381/361; 379/433

(58) Field of Search ..... 381/91, 160, 163, 381/355, 356, 357, 361, 362; 379/433

(56) References Cited

U.S. PATENT DOCUMENTS

| | | | | |
|---|---|---|---|---|
| D. 29,707 | | 11/1898 | Mulconroy . | |
| D. 135,303 | | 3/1943 | Scher . | |
| D. 216,802 | | 3/1970 | Kliewer . | |
| D. 320,798 | | 10/1991 | Holt . | |
| D. 396,235 | | 7/1998 | Tate et al. . | |
| 2,851,544 | | 9/1958 | Wisdom . | |
| 3,231,688 | | 1/1966 | Ugartechea . | |
| 3,632,902 | | 1/1972 | Wahler . | |
| 4,001,893 | | 1/1977 | Yamamoto . | |
| 4,434,507 | * | 2/1984 | Thomas | 381/160 |
| 4,773,091 | | 9/1988 | Busche et al. . | |
| 4,823,384 | | 4/1989 | Lindsay . | |
| 4,850,016 | | 7/1989 | Groves et al. . | |
| 5,117,461 | | 5/1992 | Moseley . | |
| 5,144,670 | * | 9/1992 | Negishi | 381/160 |
| 5,173,942 | * | 12/1992 | Hirose | 381/160 |
| 5,182,774 | | 1/1993 | Bourk . | |
| 5,220,608 | * | 6/1993 | Pfister | 381/160 |
| 5,239,578 | | 8/1993 | Regen et al. . | |
| 5,268,965 | | 12/1993 | Badie et al. . | |
| 5,282,245 | | 1/1994 | Anderson . | |
| 5,329,593 | | 7/1994 | Lazzeroni et al. . | |
| 5,341,420 | | 8/1994 | Hollier et al. . | |
| 5,343,523 | | 8/1994 | Bartlett et al. . | |
| 5,394,467 | | 2/1995 | Kepley, III et al. . | |
| 5,448,637 | | 9/1995 | Yamaguchi et al. . | |
| 5,491,747 | | 2/1996 | Bartlett et al. . | |
| 5,524,058 | | 6/1996 | Moseley . | |
| 5,764,783 | * | 6/1998 | Ferralli | 381/160 |
| 5,854,848 | * | 12/1998 | Tate et al. | 381/357 |
| 6,009,184 | * | 12/1999 | Tate et al. | 381/357 |

FOREIGN PATENT DOCUMENTS 0 455 160 11/1991 (EP) .

OTHER PUBLICATIONS

Wickstrom, Timothy K., "Microphones for Multimedia Speech Applications," Knowles Electronics, Inc., Itasca, IL.

* cited by examiner

*Primary Examiner*—Sinh Tran
*Assistant Examiner*—Suhan Ni
(74) *Attorney, Agent, or Firm*—Burns, Doane, Swecker & Mathis LLP

(57) ABSTRACT

An apparatus is disclosed for the cancellation of ambient noise that impinges upon the front surface of a pressure differential microphone means. The apparatus utilizes one or more curved surfaces that act as ambient noise waveform reflectors. The reflectors cause ambient noise to impinge on the back surface of the microphone. In addition, the reflectors deflect a speaker's voice which is directed toward the front surface of the microphone to be deflected away from the back surface of the microphone.

1 Claim, 13 Drawing Sheets

NOISE CONTROL DEVICE

BACKGROUND OF THE INVENTION

This invention relates generally to noise-canceling microphones and related devices. More particularly, this invention relates to a bi-directional noise control device for use in environments that have random ambient noise.

Microphone units typically operate in environments where unwanted noise is present. For example, a person listening to someone talking on the telephone may be distracted from the speaker's voice because of background noise emanating from machinery, traffic, appliances, or other ambient sounds. Background noises may be reduced for the listener if the person talking into the telephone is using a noise-canceling type microphone.

Many noise-canceling microphone element designs employ front and rear sound ports which allow sound to enter both sound ports and impinge upon the diaphragm simultaneously in opposite directions resulting in little or no signal being generated by the microphone. This technique is applied in a wide variety of cardioid microphones as well as telephone handset transmitters and headsets. Some of these microphones employ acoustic tuning to the rear port to make the microphone more frequency-responsive.

Noise-canceling microphones depend upon two factors for their operation. The first factor is the polar pattern of the microphone (usually bi-directional) and the assumption that the noise to be reduced is not on the maximum sensitivity axis of the microphone. The second factor is the different responses of the bi-directional microphone for a sound source close to the microphone, such as sound entering the front sound port, and a sound source at a distance to the microphone, such as sound entering the front and rear sound ports.

When the sound source is close to the front sound port of the microphone, the sound pressure will be several times greater at the front sound port than at the rear sound port. Since the microphone responds to the difference of sound pressure at the two entries, someone talking close to the microphone will provide a substantially higher signal strength than a remote sound, where the sound pressure is equal in magnitude at the two entry ports Because of construction restraints inherent in front and rear sound port microphone designs, one port of the microphone is always more sensitive than the other. This results from the need to provide a supporting structure for the diaphragm and the resulting impedance that the structure presents to sound entering the rear sound port microphone element. It is common practice for the more sensitive port to be faced forward to capture the desired sound while the less sensitive port is utilized for capturing and reducing or nullifying the undesired background noises.

If the front and back sensitivities of the microphone element were equal, then theoretically 100% noise rejection would be possible whenever noise of equal pressure were subjected to both entrances to the microphone. In practice, however, only 10–20 dB noise reduction is possible using the currently available microphone elements for frequencies below approximately three KHz.

Frequency response is another factor that differentiates noise-canceling microphones. Frequency response is essentially flat in the near field (a sound source close to the front sound port) over the audio band. In the far field (a remote sound source), the frequency response increases in frequency until the pressures at the front and rear sound ports of the unit are 180 degrees out of phase, at which point resonance occurs. At some frequency, the microphone becomes more sensitive to axial far-field sounds than axial near-field sounds. This crossover frequency will occur at a higher frequency for a microphone with a shorter port separation than a microphone with a longer port separation.

Several devices, both electrical and mechanical, used for noise-cancellation purposes exist but have potential drawbacks such as the need for preprocessing. The negative effects of reflections, calibration difficulties, high costs, and operating environments also pose problems. For example, in environments in which human speech is the ambient noise, signal-processing techniques such as filtering cannot effectively be used because the ambient human speech is at the same frequency as the desired speaker's voice and because the ambient noise is random, non-constant or non-periodic.

SUMMARY OF THE INVENTION

The apparatus of the present invention enhances the performance of pressure differential microphones used to cancel or reject background noise. When the pressure differential microphone and the apparatus of the present invention are used together, they form an electroacoustic noise rejection system exceeding the performance of commercially available technologies.

The present invention provides a high degree of cancellation of the impingement of ambient noise upon the front surface of a pressure differential microphone by directing the same ambient noise upon the back side of the microphone. The present invention causes ambient noise, including voice, non-constant noise, non-periodic noise, and random noise, to enter the microphone on both sides of the microphone simultaneously with the strength of the sound on the back side being relatively slightly higher to overcome the relatively higher impedance of the back side of the microphone, thus nullifying the effect of the noise sound waves. Furthermore, the present invention deflects the user's voice (the desired sound to be transmitted) away from the back side of the microphone.

The present invention utilizes one or more curved surfaces that act as a reflector to direct ambient noise onto the back side of the microphone, even when the rear port of the microphone is not aligned with the source of the greatest ambient noise. In addition, the sound pressure of the ambient noise entering the back side of the microphone is increased by the reflector. The ambient noise sound waves entering the front of the microphone are canceled at the microphone by the same ambient noise converging upon the back surface of the microphone. The curved reflector also acts to deflect the speaking voice away from the back side of the microphone so that the user's voice enters the front side of the microphone only, essentially preventing self-cancellation of the user's voice.

In accordance with the present invention, a noise-controlling apparatus for use with a directional microphone is provided, comprising a housing having a barrier element and a base element, the barrier element housing the microphone, the base element having a curved reflector surface extending from the back side of the barrier element, the curved reflector surface deflecting a user's voice away from the microphone and deflecting ambient noise toward the microphone.

In another aspect of the invention, a noise-controlling apparatus is provided comprising a microphone having a sound-receiving front side and a sound-receiving back side, a housing having a barrier element, the barrier element defining a sound opening that extends from a front side of the barrier element to a back side of the barrier element, and a housing having a curved reflector surface positioned adjacent to the back side of the barrier element to deflect a user's voice away from and to direct ambient noise to the sound-receiving back side of the microphone.

In one aspect of the present invention, a noise-controlling apparatus for use with a directional microphone is provided. The device has a housing with a barrier element and a base element. The barrier element has an opening that extends from the front side to the back side of the barrier element. A directional microphone is located in the barrier element opening. The housing also has a curved surface that extends radially about a main longitudinal Z axis. The curved surface acts as a reflector that extends away from the back side of the barrier element. The reflector deflects a user's voice away from the back side of the microphone but deflects ambient noise to the back side of the microphone.

The present invention produces pressure equalization between the ports when the wave front of the far field sound approaches the rear port and a pressure zone is created. When the instantaneous pressure on the rear port is slightly increased due to the pressure zone, thereby overcoming microphone sensitivity differences between the front and back ports, the instantaneous pressure becomes close to the instantaneous pressure on the front port (due to the far field wave front) and thereby the rejection of the far field noise becomes present and useful. This effect is not frequency-dependent and does not require phase-based interference to produce the noise rejection effect.

The noise-controlling apparatus of the present invention is not frequency-dependent, and therefore does not rely on phase-related constructive or destructive interference.

BRIEF DESCRIPTION OF THE DRAWINGS

The invention will be described in greater detail with reference to the accompanying drawings in which the like elements bear like reference numerals, and wherein.

DETAILED DESCRIPTION OF THE PREFERRED EMBODIMENTS

Apparatus 20 of the present invention improves the noise-cancellation effects of pressure differential microphones, such as a bi-directional microphone 22, for voice recognition and speech transmission when used in ambient noise environments. The present invention can be used with telephone handsets, as well as voice recognition systems, as well as in any number of a variety of environments and devices, such as but not limited to airplane telephones, cellular telephones, automobile telephones, telephone headsets, and stage microphones. The present invention works particularly well in environments that have random, non-periodic noise, non-constant noise, or ambient human speech noise, such as stock exchange floors and trading rooms. However, the device is also applicable to environments in which the ambient noise is constant or periodic and not speech noise. The present invention improves voice recognition and speech transmission clarity by enhancing the signal-to-noise ratio over a frequency range up to 13 KHz, as opposed to conventional devices that generally range up to 4 KHz or less.

Figure 1:
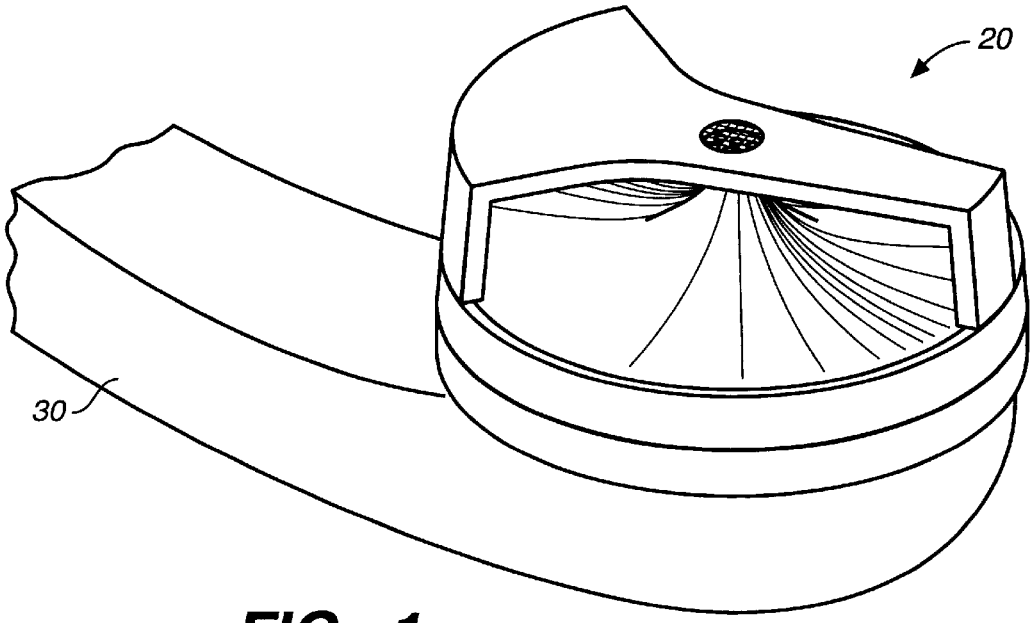
FIG. 1 is a perspective view of the apparatus of the present invention connected to a telephone handset.
Figure 2:
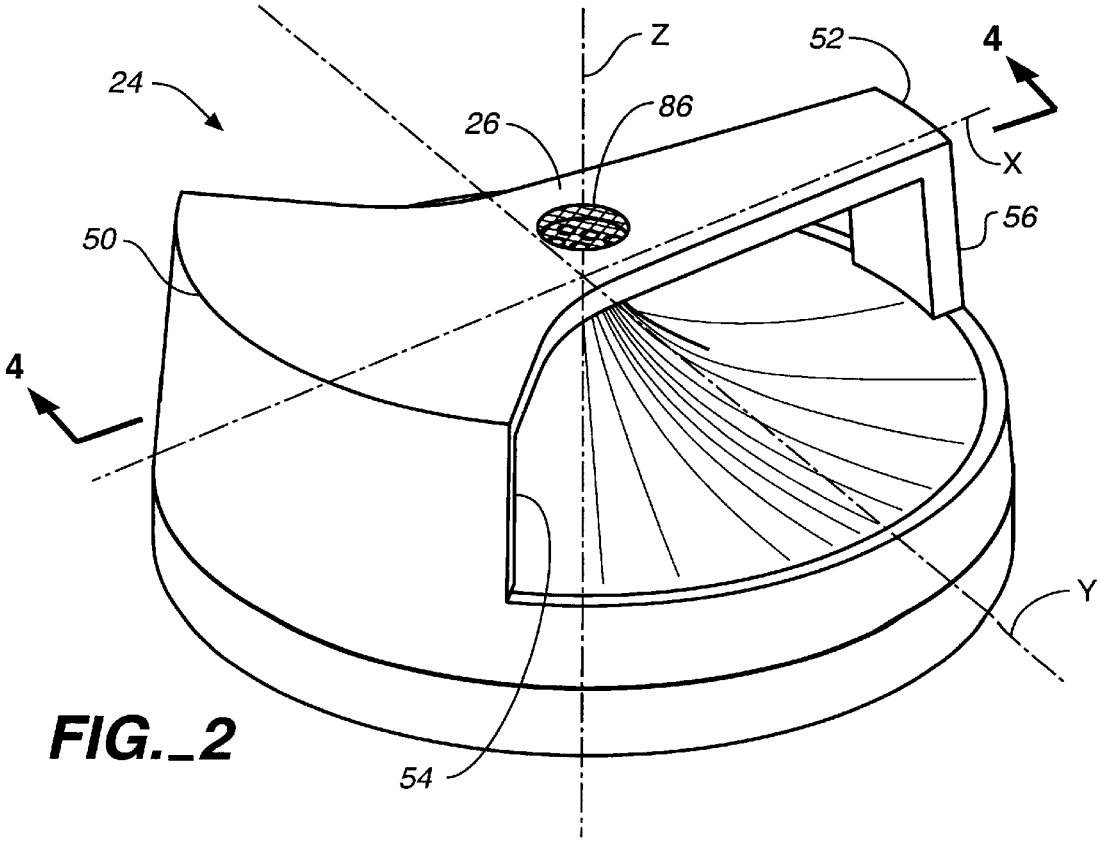
FIG. 2 is a perspective view of the apparatus of the present invention.
Figure 4:
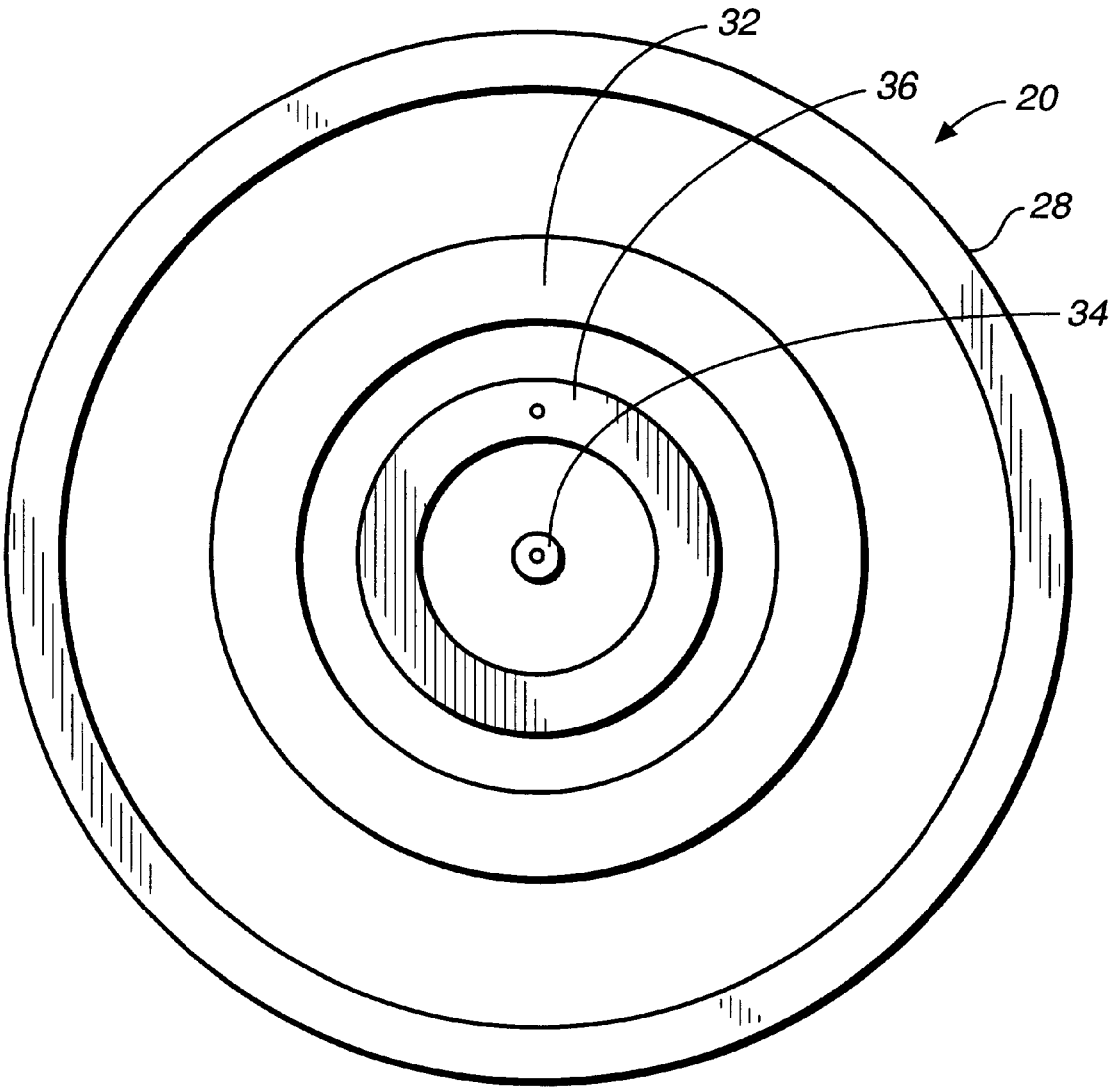
FIG. 4 is a bottom plan view of the apparatus.
Figure 5:
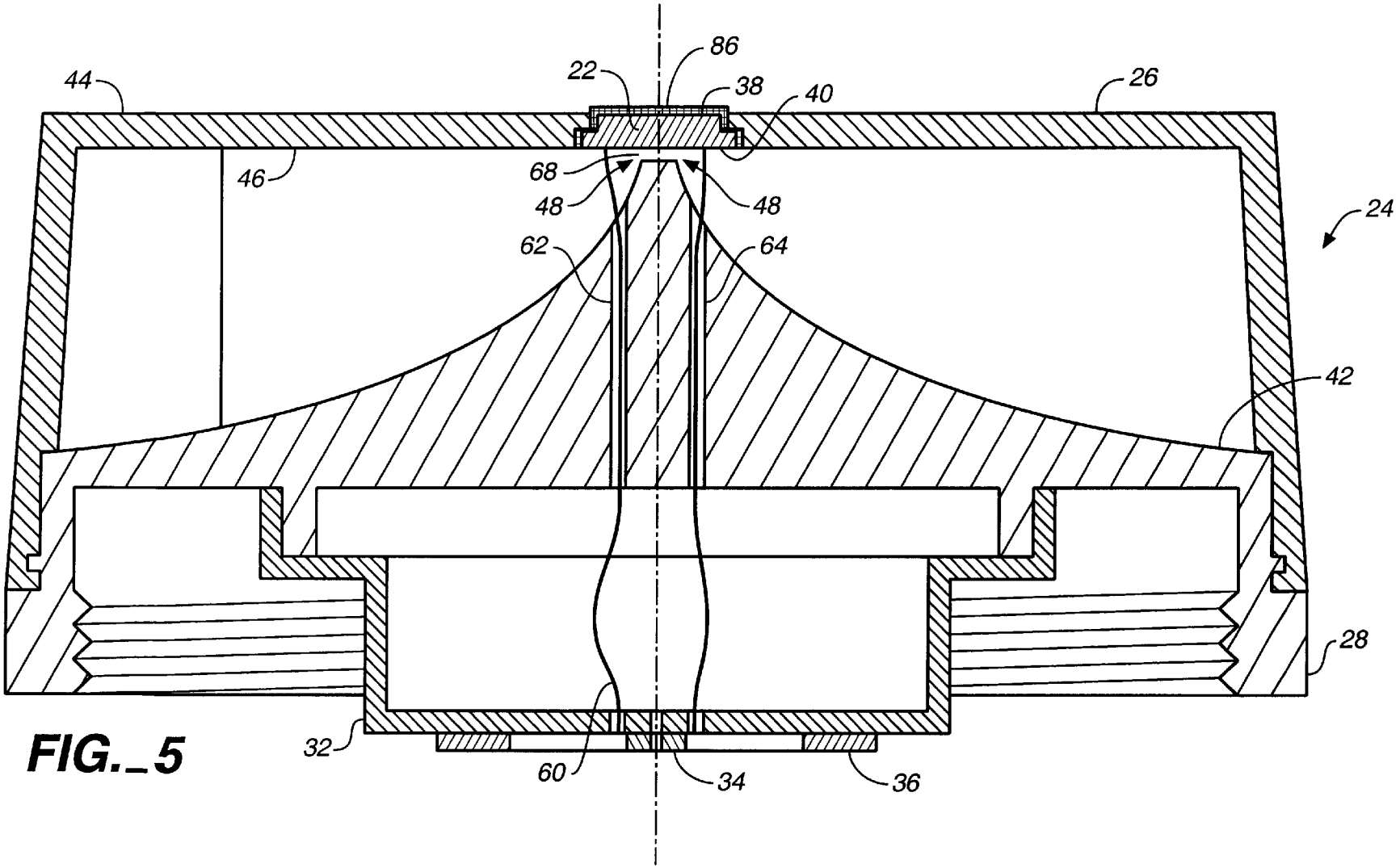
FIG. 5 is a cross-sectional view taken along line 5—5 of FIG. 2.

The first embodiment of the present invention is shown with a telephone handset. As shown in FIGS. 1 and 2, the apparatus 20 attaches onto a standard telephone handset 30 in place of the original transmitter. The apparatus 20 includes a housing 24 comprising a sound barrier element 26 and a base element 28. As shown in FIGS. 4 and 5, housing adapter 32 has electrical contacts 34 and 36 and is attached to base element 28 to make the proper contacts with the handset 30. As will be recognized by one of ordinary skill in the art, housing adapter 32 may have a variety of configurations to fit a number of devices in which the present invention may be used. In some devices in which the present invention will be used, no housing adapter will be needed.

As shown in FIG. 5, a pressure differential microphone 22 has a front port 38 and a rear port 40. The apparatus of the present invention concentrates ambient noise on the rear port 40, while deflecting the speaker's voice away from the rear port, using a curved reflector surface 42 and the sound barrier element 26. An alternative to using one pressure differential microphone is to have two microphones, one placed at the front port 38 location and the second placed at the rear port 40 location. The two microphones would operate in the same manner as a directional microphone. The barrier element 26 has a front side 52 and a back side 46 and extends across the width, or the X axis, of the apparatus 20 and, in conjunction with the curved reflector surface 42, forms a circular ambient-noise sound-concentration zone 48.

Figure 3:
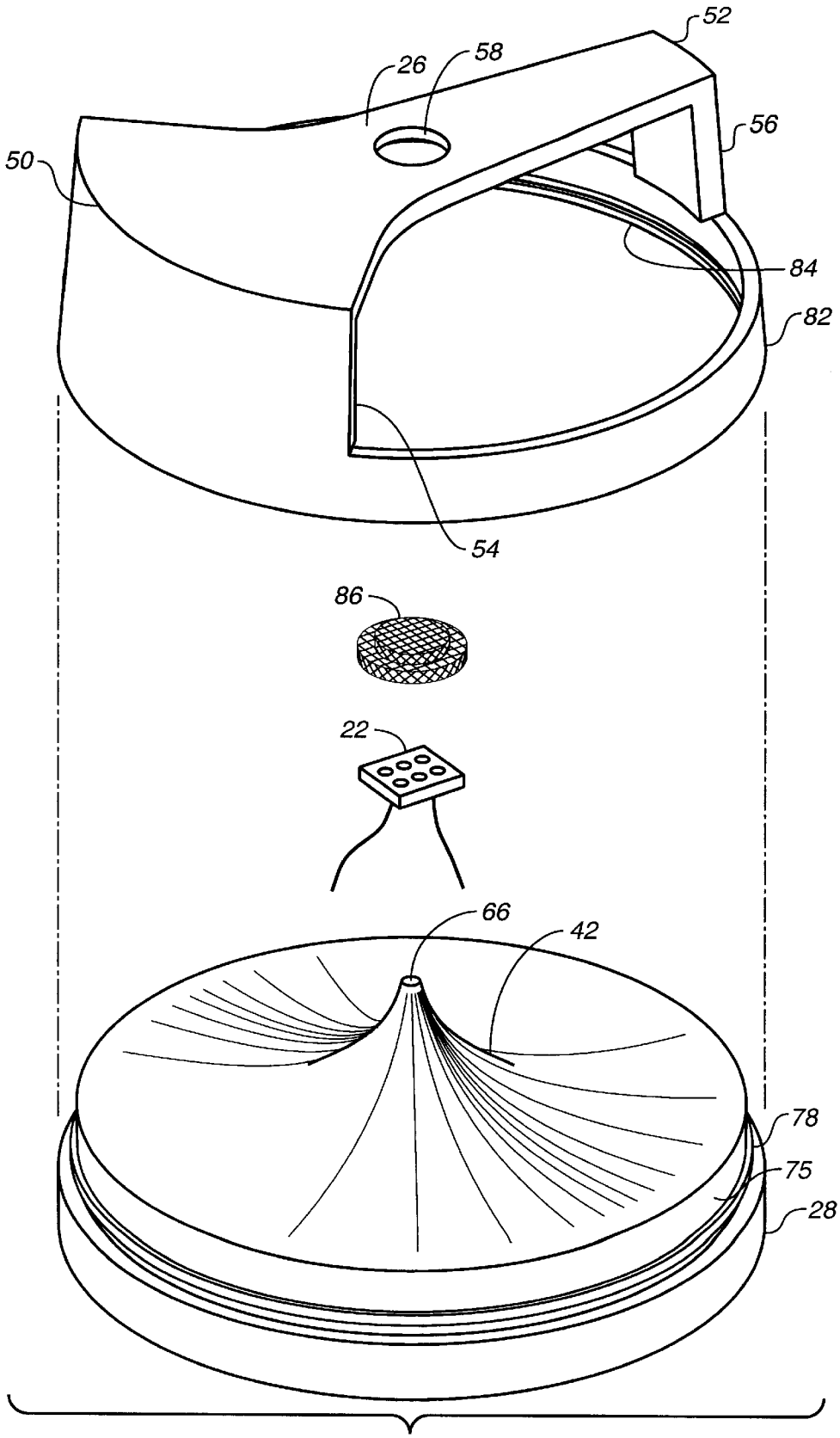
FIG. 3 is an exploded perspective view of the apparatus.
Figure 6:
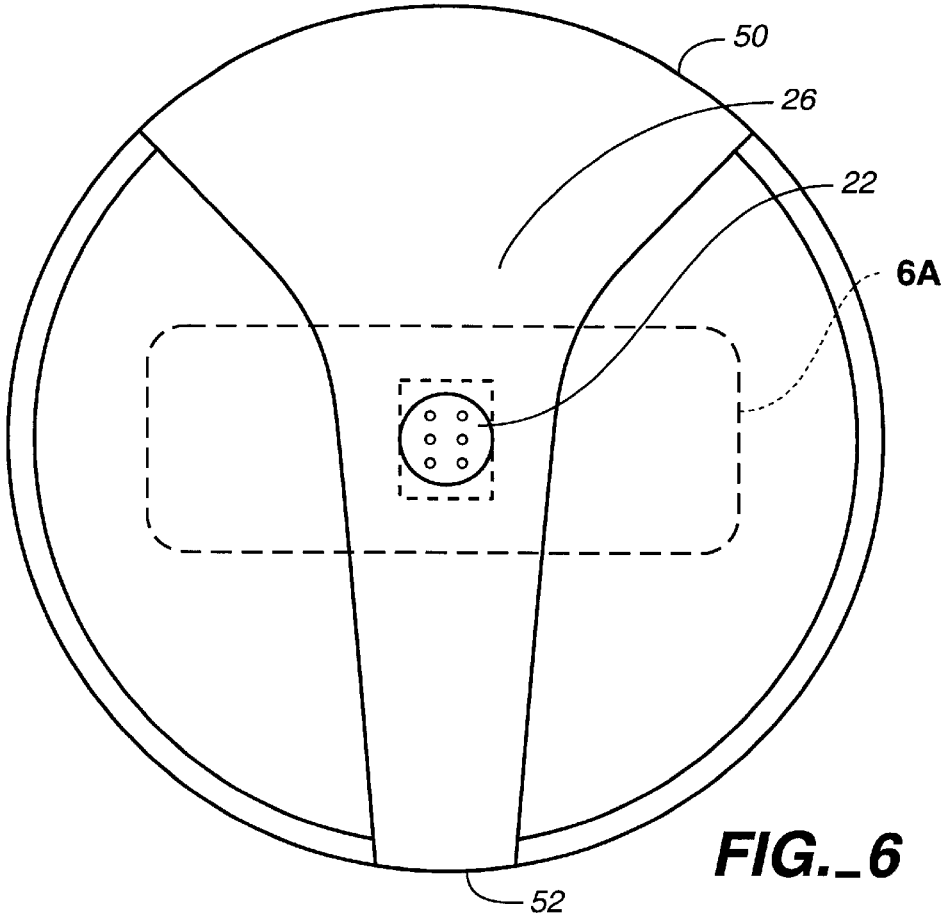
FIG. 6 is a top plan view of the apparatus.
Figure 6A:
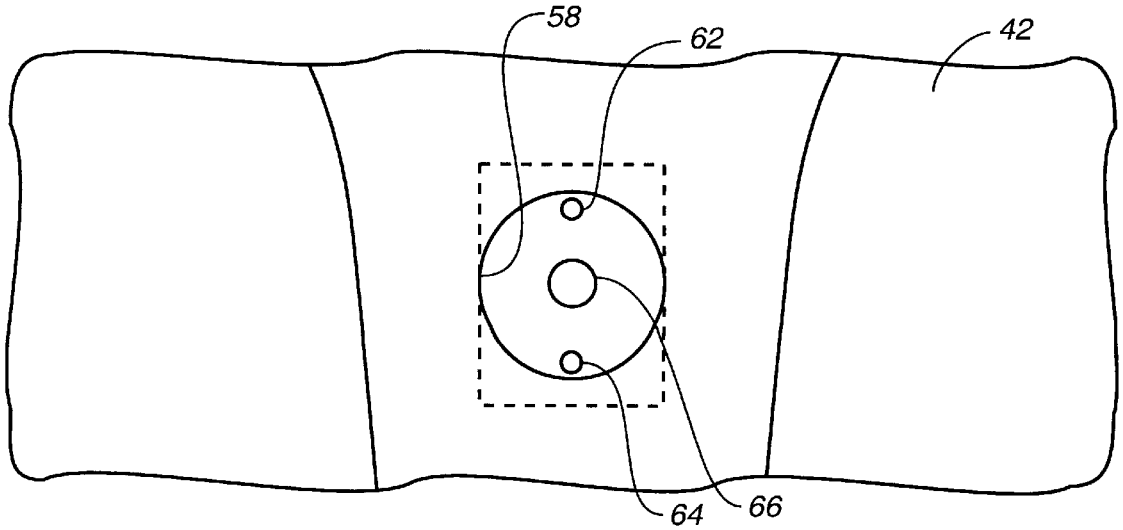
FIG. 6A is an enlarged top plan view of the portion 6A of FIG. 6 with the microphone removed from the opening in the top of the apparatus.

The base element 28 is designed to screw onto a standard telephone handset in place of the original transmitter. For purposes of description herein, the main X, Y, and Z axes are defined in FIG. 2. The X axis is defined as being across the housing 24 in the general direction of the length of the barrier element 26. This direction is described as being in the "general" direction because the barrier element 26 is tapered from its first end 50 to its second end 52. The X axis therefore is in the direction of a center line running along the length of the barrier element 26. The barrier element 26 is wider at the first end 50 so that a user speaking into the handset may rest their cheek against the wider end 50. However, the barrier element 26 does not have to be wider at one end. The barrier element 26 is supported at the first end 50 by flange 54 and at the second end 52 by flange 56. Opening 58, as best seen in FIGS. 3 and 6A (filter not shown), extends through the barrier element 26 from the front side 44 to the back side 46, and houses the microphone 22. Wires 60 extend through holes 62 and 64 to make contact with the electrical contacts 34 and 36. In the alternative, the wires may extend along the perimeter of the base element 26 and then through the base element 28 at the outer peripheral edge.

Curved reflector surface 42 curves along the X, Y and Z axes (that is, the depth, width, and height directions) until reaching an apex 66 at a main Z axis. The curved reflector surface 42 rises slowly from the base element 28 initially, and then increases in steepness as the curved reflector surface approaches the apex 56, thus forming a generally parabolic curved surface when viewed in a cross-section. The curved surface extends radially from and is rotationally symmetrical about the main Z axis. A generally parabolic curved surface, as opposed to a semi-circular curved surface, is preferred so that the reflector reflects sound over a broad range of frequencies and directions with minimal resonance. The generally parabolic curved surface does not have to conform to a simple mathematical equation and can be semi-parabolic, quasi-parabolic, or any of a large variety of generally parabolic curved surfaces. In furtherance of eliminating or minimizing resonance, the back side or underside 46 of the barrier element 26 and the intersection of the curved reflector surface 42 forms a non-tubular sound concentration zone 48 around a slot 68 located between the apex 66 and the barrier element 26. The space bounded by the underside of the barrier element 46 and the curved reflector 42 does not form a column of air as the tubular structures of the prior art often do which can produce resonance at certain frequencies. Rather, the sound concentration zone 48 is an "open" reflector system similar to the human ear so as to eliminate or at least minimize resonance around the slot 68.

One purpose of the curved reflector surface 42 is to reflect and concentrate ambient noise through slot 68 onto the back side of the microphone 22. Slot 68 is formed where the opening 58 exits through the barrier element 26 adjacent to the apex 66. The generally parabolic curved surface of the reflector 42 helps to ensure for each angle of incidence of ambient noise 70 that there is some angle of reflection for directing the ambient noise 70 to the back side of the barrier element 26, the slot 68, and the back side of the microphone 22, as best shown in FIG. 6. In addition, because the curved reflector surface 42 is much larger relative to the slot 68, the reflector increases the sound pressure of the ambient noise 70 on the sound-receiving back side of the microphone 22 to overcome the inherent acoustical impedance of the internal support structure of the microphone so that the ambient noise impinges on the sound-receiving front side and sound-receiving back side of the microphone at substantially equal sound pressures for better noise-cancellation.

Figure 8:
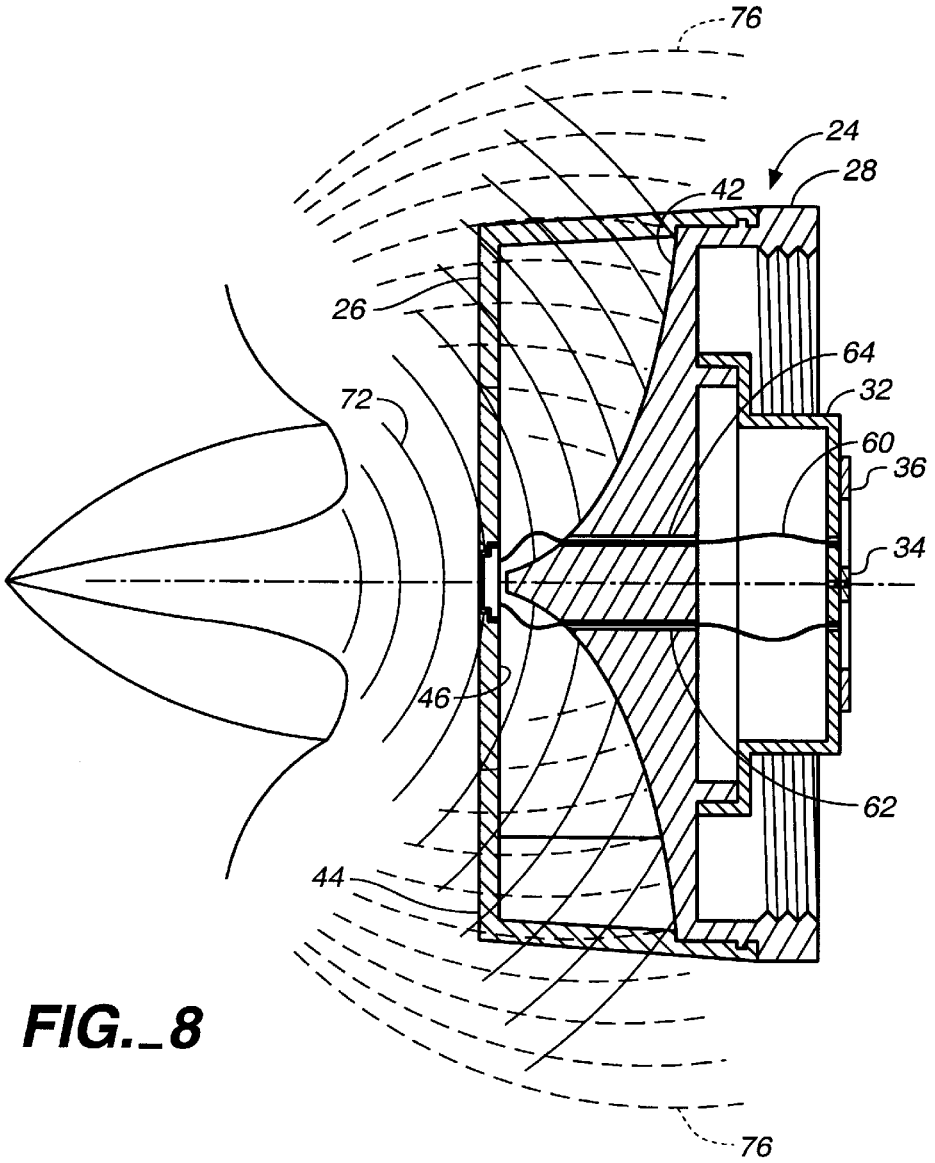
FIG. 8 is a diagrammatic representation of the speaker's voice interacting with the apparatus.

Another purpose of the curved reflector surface 42 is to deflect the user's voice away from the back side of the microphone 22 so as to reduce or eliminate self-cancellation of the user's voice which is caused by the user's voice entering the back side of the microphone. The voice 72 of the user 74 is directed towards the top of the barrier element 26 generally along the main Z axis of the apparatus 20 into the front entrance of the microphone as shown in FIG. 8. After the voice sound 72 passes the barrier element 26, the voice 72 is deflected away from the rear entrance of the microphone by the curved reflector surface 42 as shown in dashed wavefront lines 76. Reflecting the voice 72 of the user 74 away from the back side of the microphone can produce a 10 dB gain over prior-art handsets because the prior-art handsets typically have some self-cancellation of the user's voice. To decrease the amount of the user's voice that might pass around the edges of the barrier element 26, the shape of the edges can be optimized to reduce refraction around the edges or to reflect the user's voice away from the underside of the microphone. The curved reflector surface 42 may be made of a large variety of materials such as but not limited to plastics, foams or rubbers.

The barrier element 26 and the base element 28 have a means for interconnecting with each other during assembly of the housing 24. For example as shown in FIG. 3, the base element 28 has a peripheral ring 78 extending from a relief surface 80. The barrier element 26 has a peripheral ring 82 adjacent flanges 54 and 56. The ring 82 has a groove 84 which corresponds with the base element ring 78 so that when the housing 24 is assembled, the barrier element 26 may be fixedly attached to base element 28. Although a snap ring and groove configuration is explained above, it should be understood that a number of attachment means may be utilized to connect the barrier element to the base element. For example, an interference fit or an epoxy may be used to connect the elements together.

The advantage of the two-piece construction of the housing 24, consisting of the barrier element 26 and base element 28, is that the parts may be manufactured independently. The two-piece construction also allows for the base elements and the barrier elements to be interchangeable; therefore, different shaped barrier elements may be matched with different shaped base elements depending on the application. In addition, the two-piece assembly allows for complex shapes and curves to be incorporated into the elements without adversely affecting manufacturing costs. In the present embodiment the two-piece construction is made from injection-molded plastic, which allows for the base element 28 to have a curved reflector surface 42 without using a complex manufacturing process.

As shown in FIG. 2, a filter 86, preferably made of a fine metallic mesh or expanded PTFE membrane, is positioned inside of opening 58 to encompass the front side of the microphone 22. In the alternative, the filter may be made from either a felt material or a sponge material. The filter softens harsh speech sounds such as plosives spoken by the user 74. The filter may also cover the rear side of the microphone.

Figure 9:
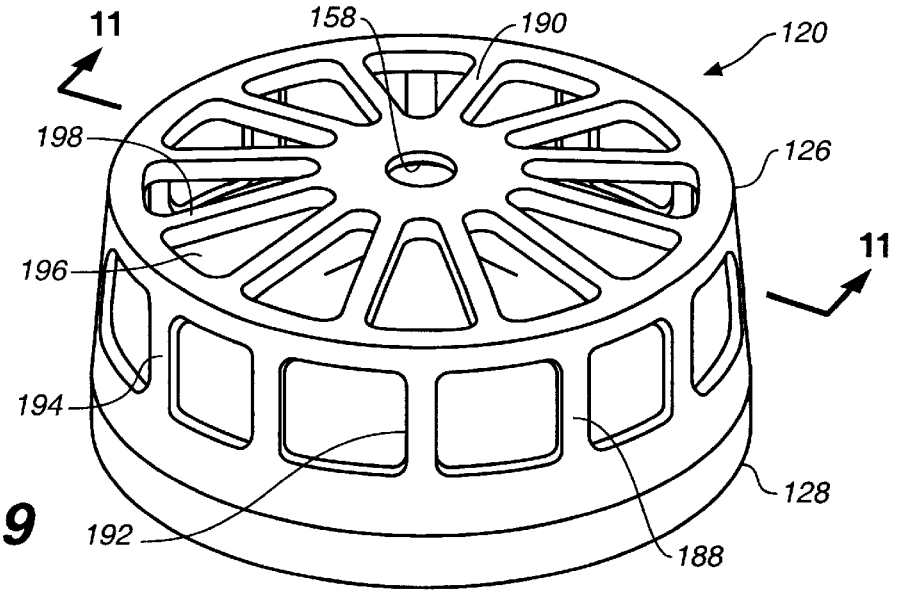
FIG. 9 is a perspective view of a second embodiment of the apparatus of the present invention.
Figure 11:
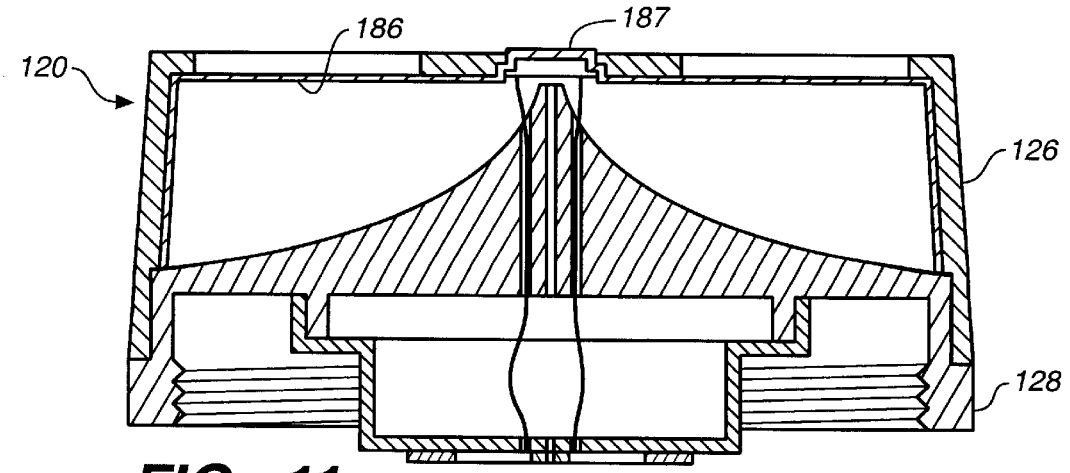
FIG. 11 is a cross-sectional view taken along line 11—11 of FIG. 9.
Figure 10:
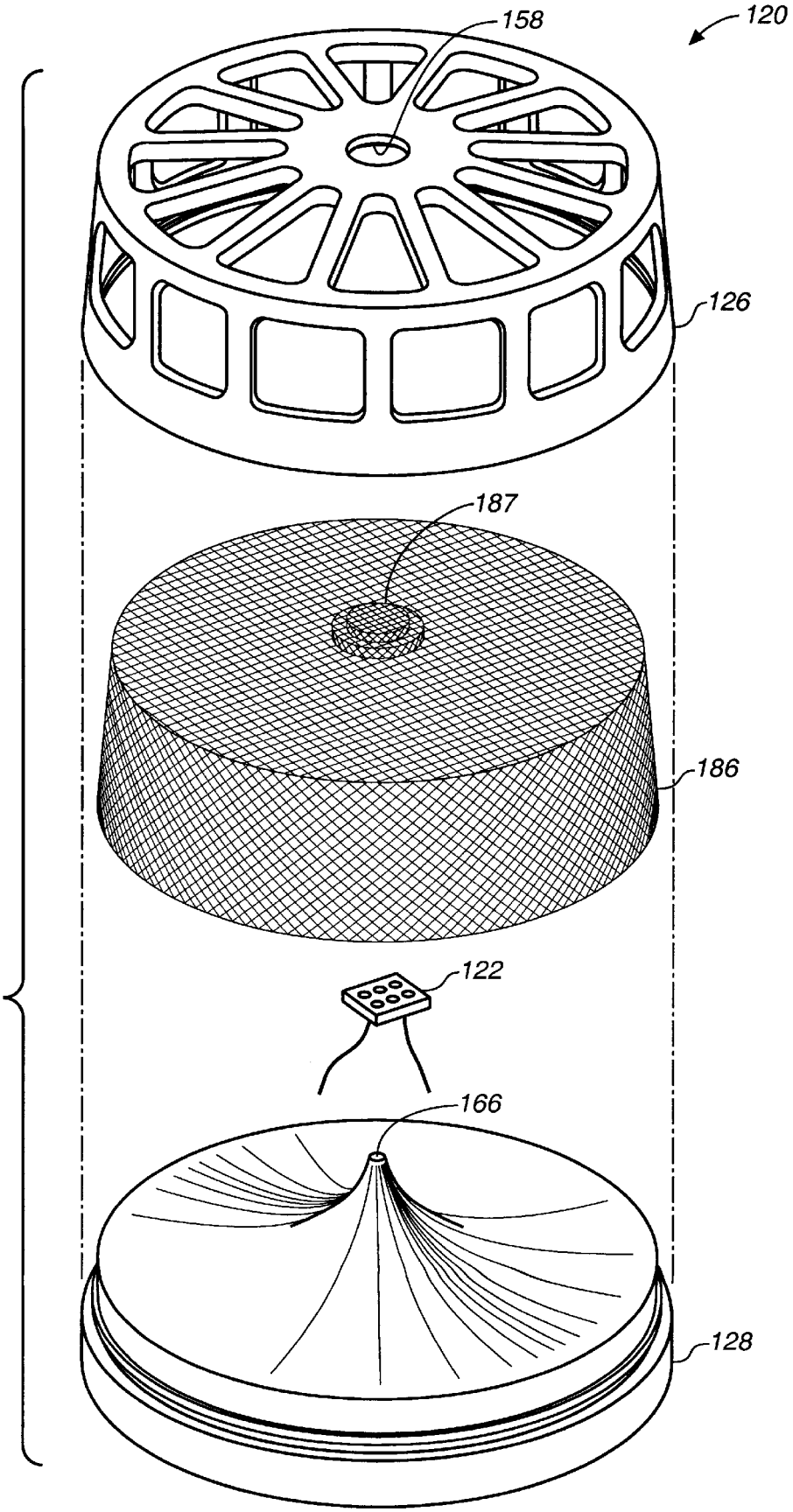
FIG. 10 is an exploded perspective view of the second embodiment.
Figure 12:
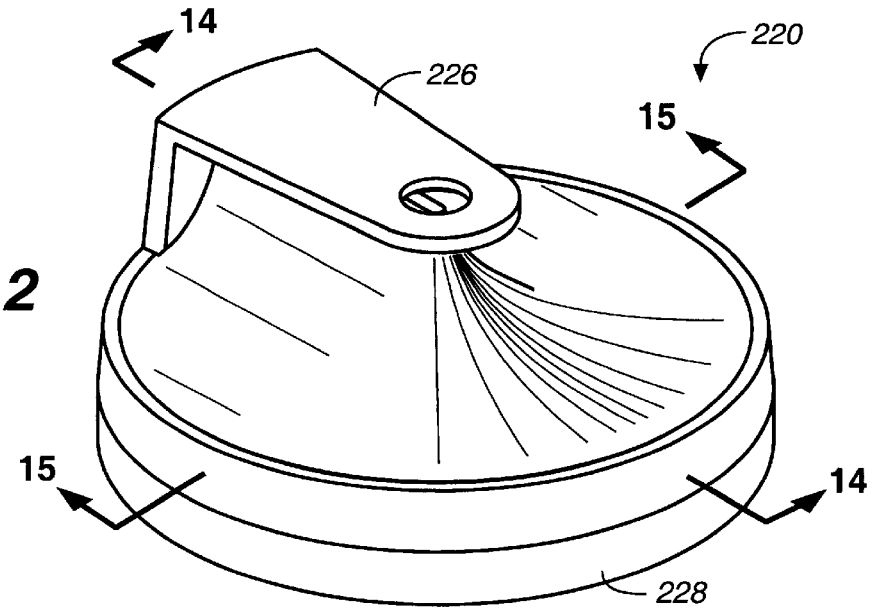
FIG. 12 is a perspective view of a third embodiment of the apparatus of the present invention.
Figure 13:
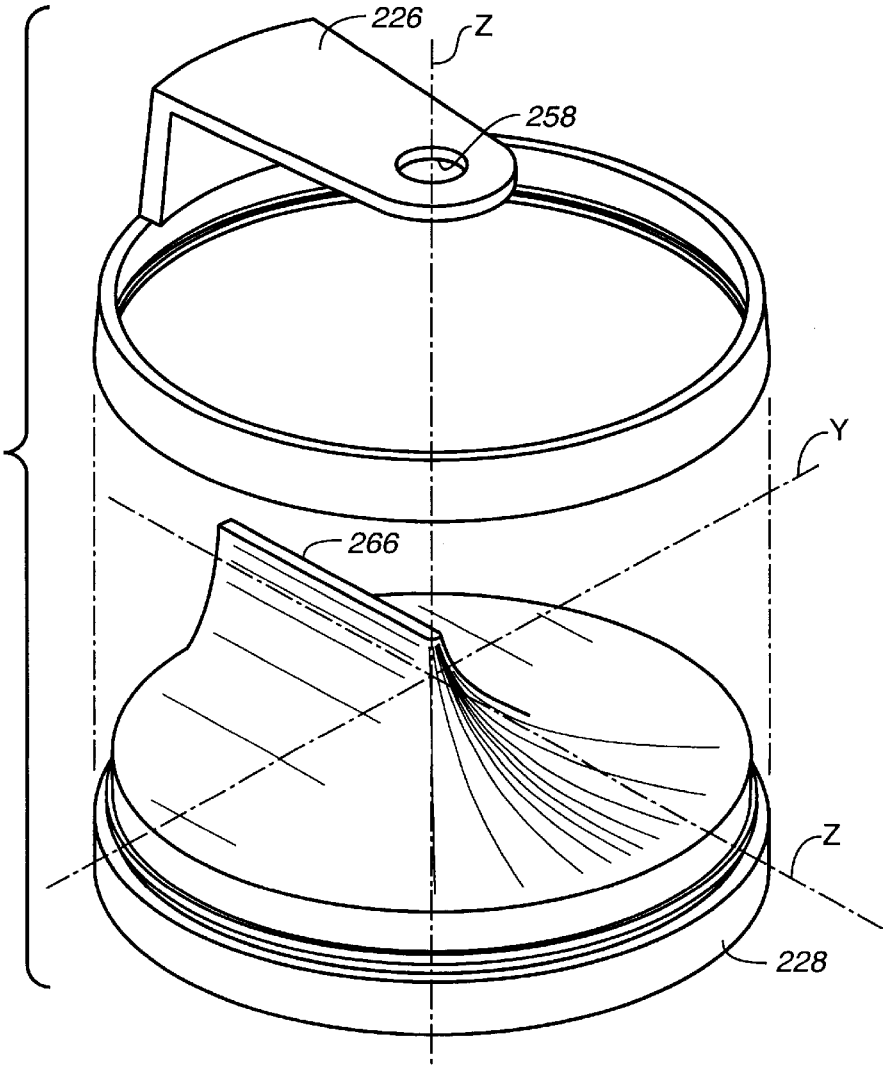
FIG. 13 is an exploded perspective view of the third embodiment.
Figure 14:
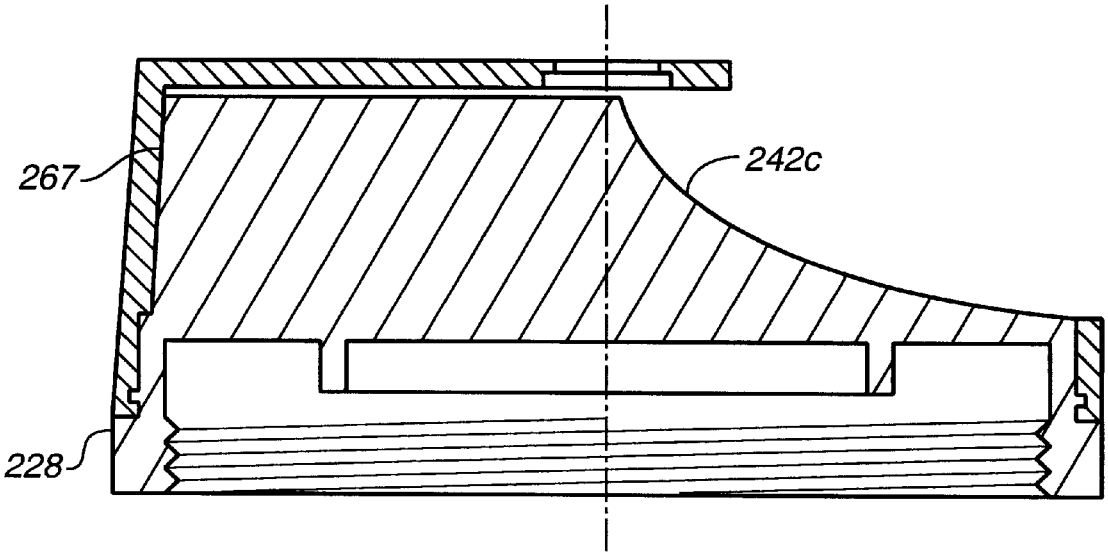
FIG. 14 is a cross-sectional view taken along line 14—14 of FIG. 12.
Figure 15:
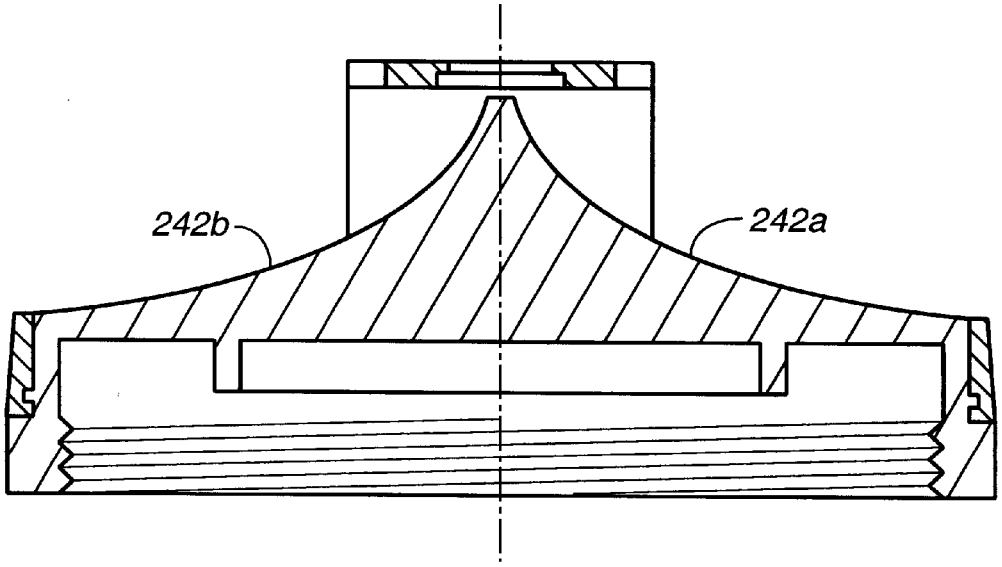
FIG. 15 is a cross-sectional view taken along line 15—15 of FIG. 12.

A second embodiment is shown in FIGS. 9, 10 and 11, wherein apparatus 120 has a base element 128 as described in the above-detailed first embodiment, and a cup-shaped barrier element 126 with a side surface 188 and a top surface 190. The side surface 188 extends around the circumference of the barrier element 126. The side surface 188 contains a series of side openings 192 spaced evenly around the circumference of the barrier element 126, defining a series of peripheral side supports 194. The top surface 190 likewise has a series of equally spaced top openings 196 that extend from the peripheral edge inward towards opening 168, defining a series of top-side structural supports 198.

The benefit of the above-described second embodiment is that the barrier element 126 has a series of structural supports 194 and 198 along the peripheral side and along the top side. The structural supports provide added durability to the apparatus 120 while maintaining the required functional openings 192 and 196 along the side and top of the barrier element 126, respectively. This second embodiment has a filter 186 similar to the above-described filter in the first embodiment, except that filter 186 is larger and is positioned adjacent to the side openings 192 and the top openings 196. The filter 186 has a raised portion 187 that extends into opening 158. A microphone 122 is placed inside of the filter raised portion 187 to be adjacent to apex 166.

A third embodiment is shown in FIGS. 12, 13, 14 and 15. This embodiment is similar to the above-described first embodiment except that the apparatus 220 has a curved reflector surface 242 that is essentially "U-shaped." The U-shaped curved reflector surface 242 has an apex portion 266 which extends from a lateral edge 267 to beyond a main Z axis. The U-shaped curved reflector surface 242 has a first curved surface 242*a* and a second and opposite curved surface 242*b*. A third curved surface 242*c* connects surfaces 242*a* and 242*b*. The three curved surfaces extend from the same plane at base element 228 to apex 266 and form the continuous reflector surface 242. The third curved surface extends over one half of the base element and is substantially identical to one half of the base element of the first embodiment shown in FIGS. 1–6. The apex portion 266 runs parallel to main X axis. A barrier element 226 is aligned axially with the apex 266 and the main X axis. The barrier element 226 extends from lateral edge 267 to beyond the main Z axis. The barrier element 226 has an opening 258 that is axially aligned with the main Z axis.

When assembled, the apex portion 266 is adjacent to the barrier element 226 and provides additional support to the barrier element 226. This additional support provided to the barrier element provides for structural integrity to the apparatus 220.

Figure 7:
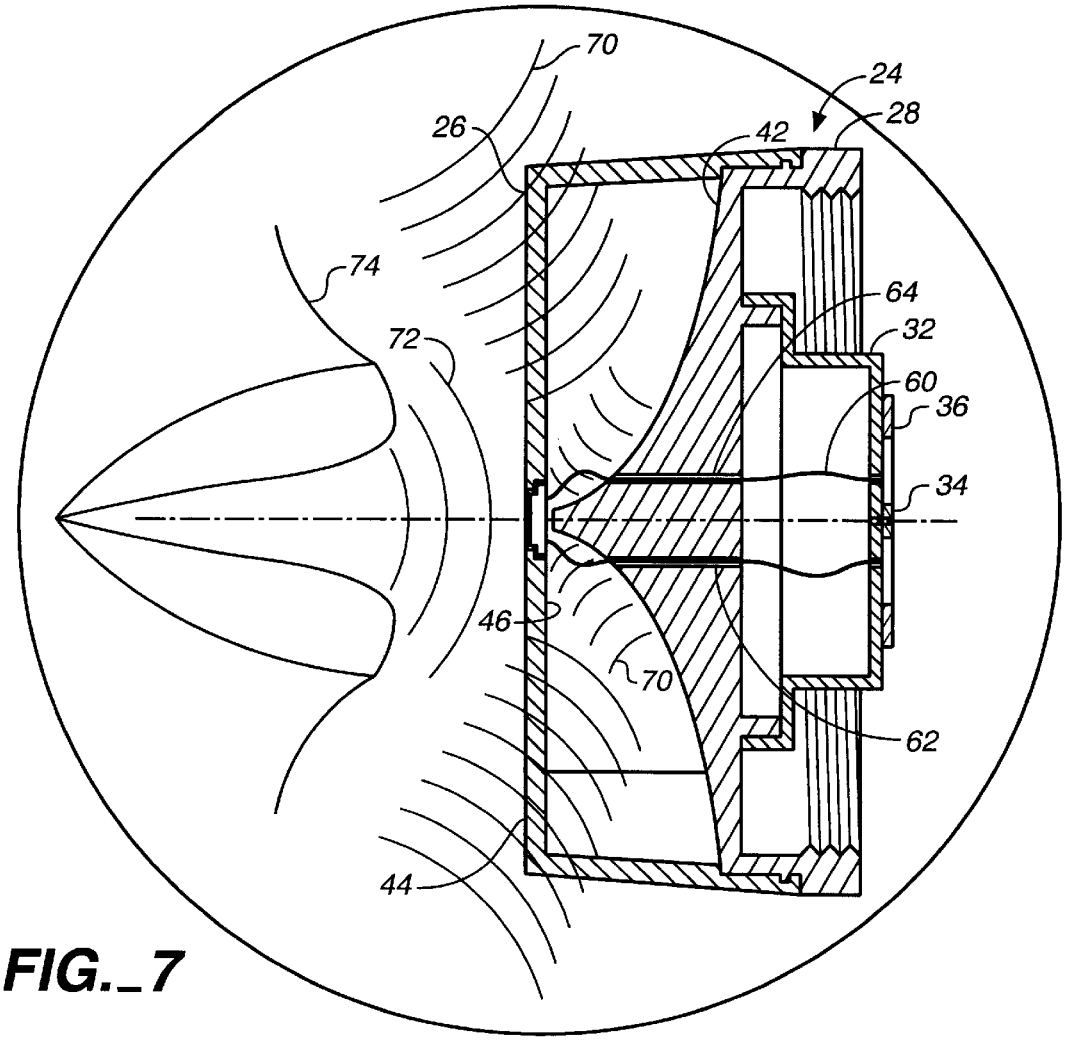
FIG. 7 is a diagrammatic representation of ambient noise interacting with the apparatus.

One way to cancel the effect of the noise pressure on the microphone is to ensure that the noise pressure felt by the front surface is equal to that felt by the rear surface. FIG. 7 illustrates the wavefronts as they traverse the apparatus and impinge upon the microphone ports. The noise 70 is modeled as a distributed spherical source having intensity $I_o$. The spherical noise source is assumed to be located at a radius R from the center of the microphone 22. The noise pressure felt on the front surface of the microphone is obtained by integrating the noise field over the upper hemisphere by using the formula:

$$N_f = \frac{I_o A \pi}{8c}$$

where A is the surface area of the microphone, c is the speed of sound in air and $N_f$ is the noise pressure impinging on the front surface of the microphone.

The noise pressure felt on the rear surface of the microphone depends on the reflector characteristics. For an isotropic, linearly elastic solid reflector, the acoustic reflectively $\alpha_r$ is given by:

$$\alpha_r = \frac{1 - 4\rho_1 c_1 \rho c \cos\theta \sqrt{1 - \left(\frac{c}{c_1}\right)^2 \sin^2\theta}}{\rho c \cos\theta + \rho_1 c_1 \sqrt{1 - \left(\frac{c}{c_1}\right)^2 \sin^2\theta}}$$

where ρ is the density of air, c is the speed of sound in air, $\rho_1$ is the density of the reflector medium, $c_1$ is the speed of sound in the reflector medium, and θ is the angle of incidence. Careful study indicates that the acoustic reflectivity is nearly unity for most metallic solids. The material chosen for the reflector of the present invention can also be shown to have a reflectivity of unity. Applying Snell's law, the noise pressure due to reflection is:

$$N_b = \int_0^L \frac{2\pi I_o}{c} \sqrt{1 + \left(\frac{df}{dx}\right)^2}\, 2\pi x \left(1 - \frac{f}{\sqrt{\frac{Af}{n\sqrt{f^2 + x^2}} + x^2}}\right) dx$$

where y =f(x) is the function that determines the shape of the reflector. This function is chosen such that $N_f = N_b$. Several families of functions satisfy the given noise-pressure-matching criterion. Of these families, functions are chosen that satisfy three criteria. The first criterion is the frequency range for which noise cancellation is desired. For the current speech application, a frequency range of 0 to 8,000 KHz is desired. By comparing the unreflected wave impinging on the front surface with the reflected wave impinging on the rear surface it can easily be shown that the reflected wave lags behind the unreflected wave. Therefore, the shape function is chosen such that the phase lag is minimal. The second criterion is that the shape minimizes the amount of near field sound reflected back to the microphone and the third is that the surface is easily manufacturable.

Noise rejection or cancellation is measured by comparing the signals of a reference microphone to a test microphone under two conditions. The first condition subjects both microphones to a close speaking voice (i.e., near field) to simulate a person speaking into the microphone at close range. The second condition subjects both microphones to ambient room noise (i.e., far field). The difference between the responses of each microphone to the two conditions is a measure of the microphone's noise rejection or cancellation effectiveness. The present invention was tested against a prior art noise-canceling headset. The present invention and the prior art headset each utilized identical microphone elements (i.e., electrets). The response of the prior art device is plotted in FIG. 16 and the response of the present invention is plotted in FIG. 17.

Both microphones were tested for noise rejection by comparing each response to that of a Peavey ERO 10 reference microphone which has no noise rejection characteristics but exhibits a well defined flat response from 20 Hz to 20 KHz. The reference microphone and the test microphone were placed in very close proximity to each other equidistant from a noise source. A near field voice source was provided by an acoustic dummy of human dimensions with a JBL Control Micro loudspeaker mounted inside the head. The loudspeaker generated sound which exited through the mouth opening. The reference microphone and the test microphone were placed 2 centimeters from the mouth opening. A far field ambient noise source was provided by another JBL Control Micro loudspeaker mounted on a movable stand about 10 feet away from the dummy.

A Hewlett-Packard 3574 two channel dynamic spectrum analyzer was used for source noise and measurement. A white noise signal of 300 millivolts was amplified (McGowen 362SL) and connected to the dummy loudspeaker. The noise signal was adjusted to 80 dB sound pressure at each of the test microphone and reference microphones. The microphones were routed to the analyzer through a Makie 1202 mixer with the reference microphone routed to channel one and the test microphone routed to channel two. With the analyzer in frequency response mode, the two signals were analyzed by the Hewlett- Packard 3574 which automatically divided their power outputs.

After plotting the near field response, the amplifier was switched to the far field loudspeaker and without moving the microphones, the sound pressure was again adjusted to 80 dB at each of the test microphone and reference microphone. This required turning up the amplifier volume because of the added distance between the loudspeaker and the microphones. The far field response was plotted to measure how much less responsive each microphone was to distant sounds. The difference between the near field and the far field response is a measure of the microphone's noise rejection.

Figure 16:
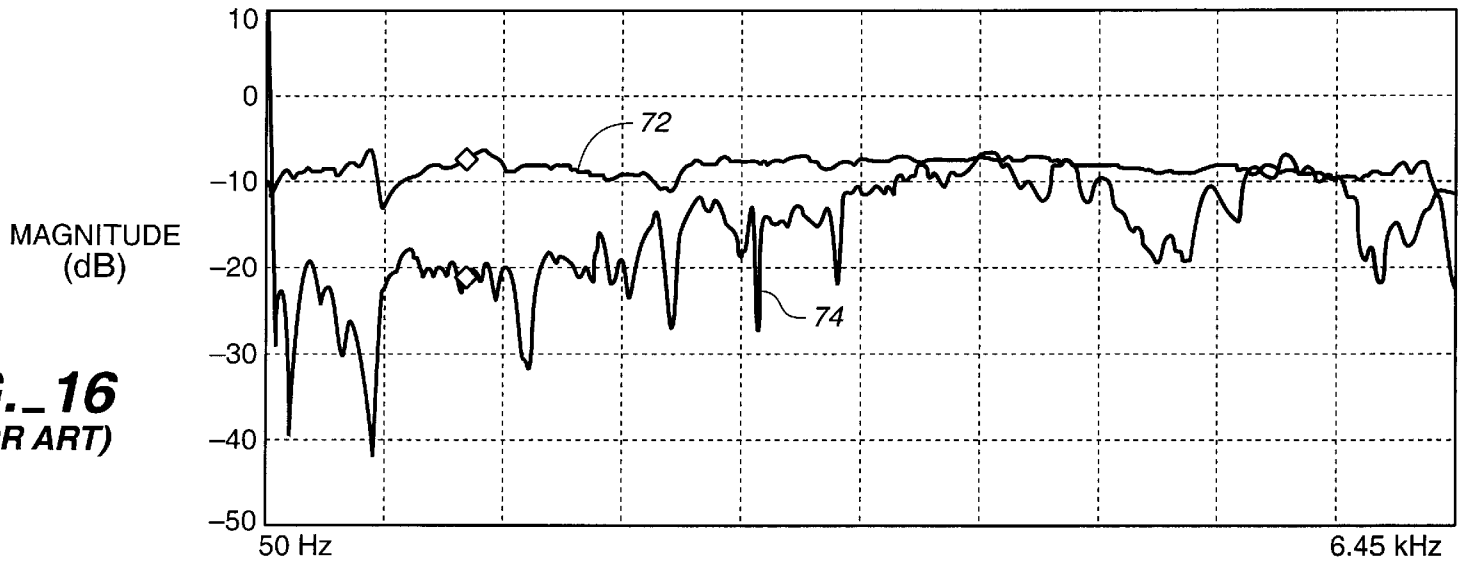
FIG. 16 (PRIOR ART)
FIG. 16 is a graph of the near field response and the far field response of a prior-art noise canceling headset.

In FIG. 16, the upper trace 89 is the near field response of the prior art headset. The prior art headset followed approximately the −10 dB magnitude line throughout the frequency range of 68 Hz to 8 KHz indicating the prior art headset had a fairly flat response but 10 dB less gain than the reference microphone. The lower trace 91 is the far field response of the microphone which varied between about 10 and 20 dB up to about 3.5 KHz at which point it began to "fade out" because the headset became more sensitive to the far field sounds than the near field.

Figure 17:
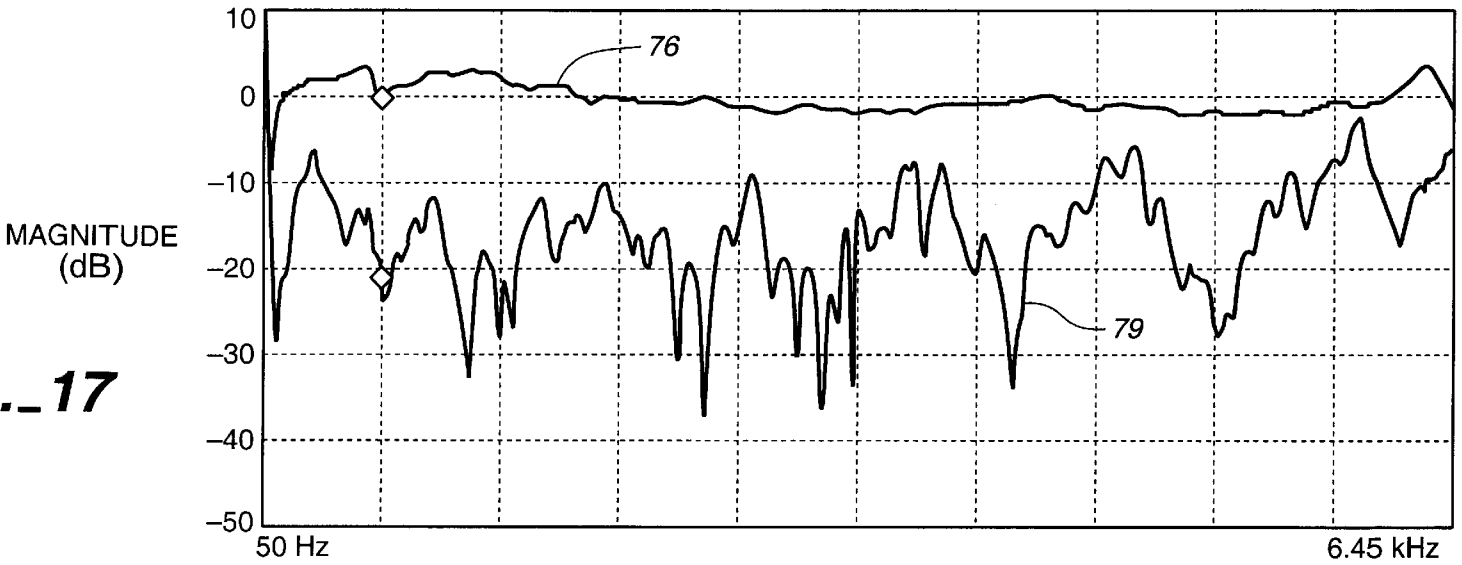
FIG. 17 is a graph of the near field response and the far field response of the apparatus of the present invention.

In FIG. 17, the same microphone element was tested in a telephone handset with the apparatus of the present invention following the same procedure. The near field response 93 followed the 0.0 dB line indicating that the handset with the present invention nearly had the same gain as the reference microphone. In addition, the noise rejection of the apparatus of the present invention was dramatically greater, ranging between 10 dB to 40 dB up to 6.45 KHz and beyond as shown by the lower trace 79.

Figure 18:
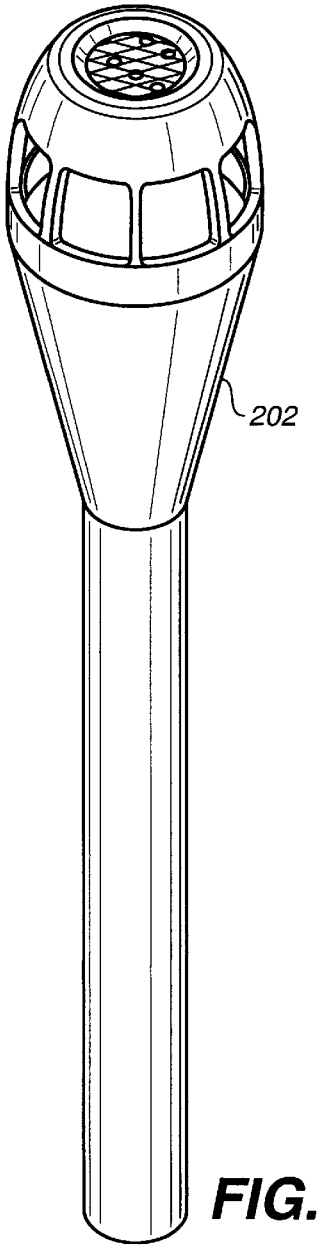
FIG. 18 is a perspective view of the present invention incorporated in a headset boom.
Figure 19:
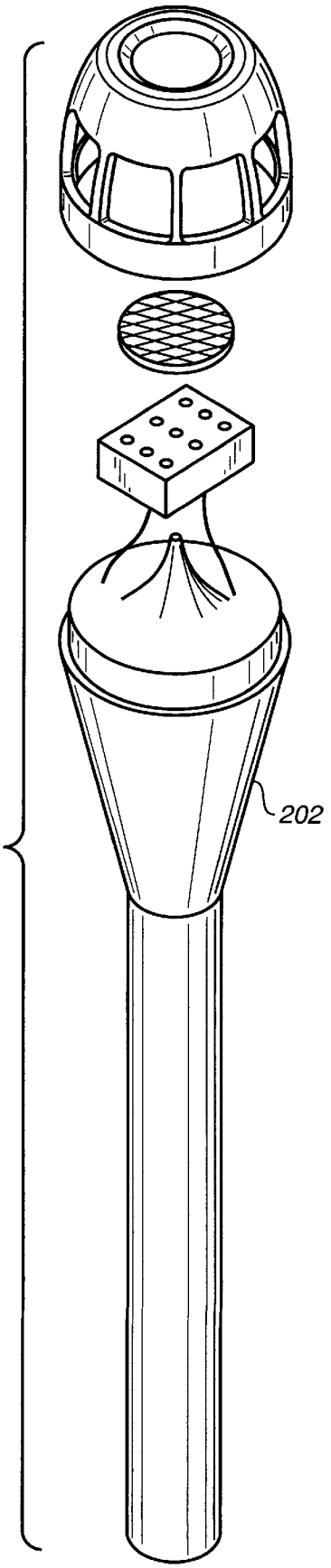
FIG. 19 is an exploded view of the headset boom shown in FIG. 18.

While the invention has been described in detail with reference to specific embodiments thereof, it will be apparent to one skilled in the art that various changes and modifications can be made, and equivalents employed, without departing from the scope of the invention. For example, in FIGS. 18 and 19, the noise control device of the present invention is shown incorporated in a telephone headset boom 202. In this embodiment, the curved reflector surface is steepened when compared to the first three embodiments described above since the headset boom is designed to be adjacent to the user's cheek.

Figures 20, 21:
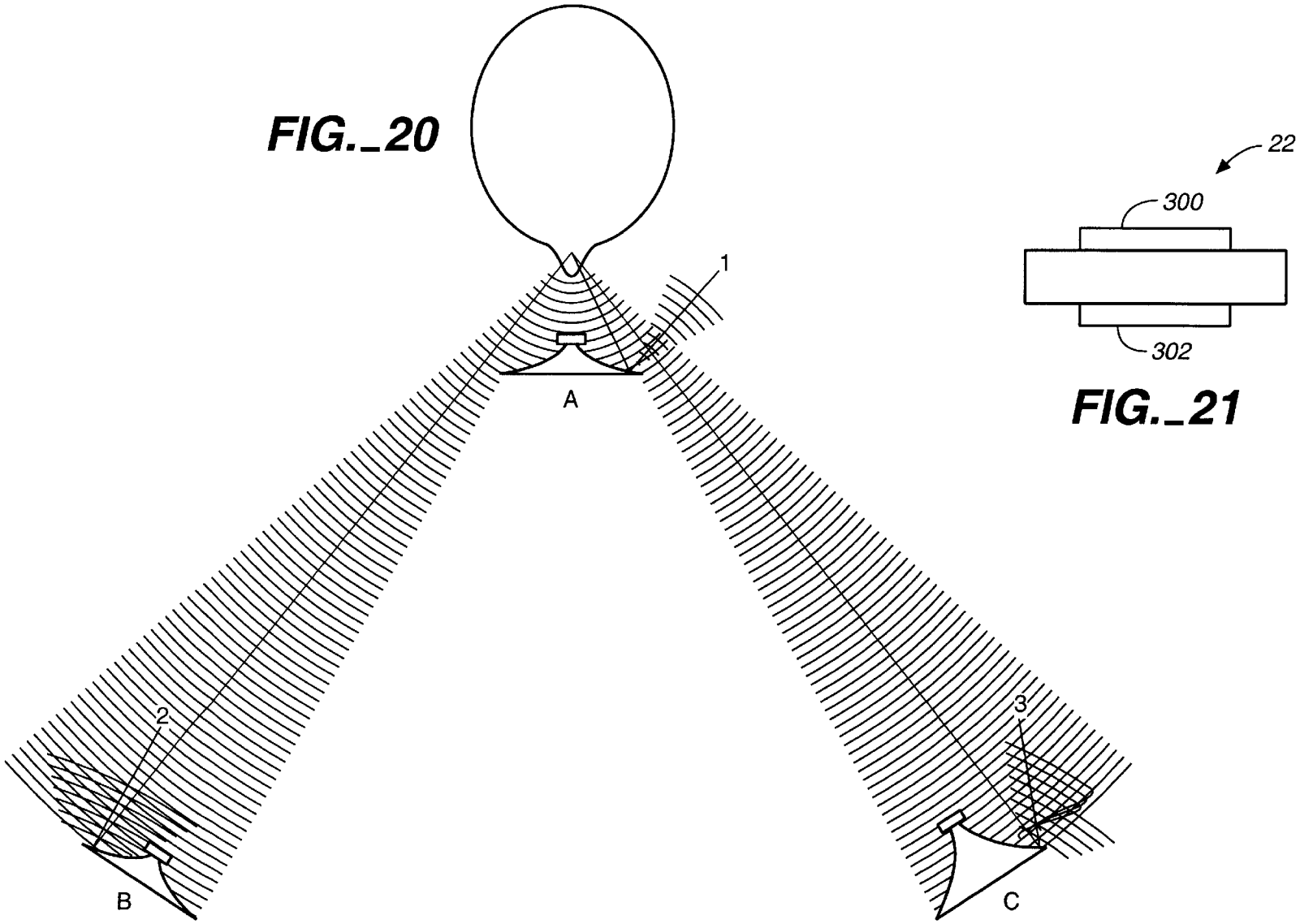
FIG. 20 is a diagrammatic representation of the speaker's voice interacting with the apparatus.
FIG. 21 shows a microphone having two opposing microphone elements.

As shown in FIG. 20, three devices A, B and C are shown. Devices A and B have shallow curved reflector surfaces with A being close to the speaker and B and C being at a distance from the speaker. C has a steepened reflector surface. The speaker's voice is shown in wavefront lines. They hit and are reflected off the curved reflectors. As shown, the reflected wavefront that reflects from the outer periphery may cause backscatter when the voice reaches the rear port of the microphone, which will result in loss of signal. Therefore, the curved reflector surface height is a function of how far away the device is intended to be used from the speaker. As shown in C, even though the wave arrives at the device almost orthogonal to it, the steeper reflector reflects the wave away from the rear port.

FIG. 21 shows a variation of the microphone 22 having two microphones 300 and 302. The microphones 300 and 302 oppose each other.

We claim:

1. A noise-controlling apparatus comprising:

a housing having a base element and a barrier element;

the barrier element having a front side and a back side, the barrier element defining a sound opening to enable sound to pass through the barrier element;

the base element having a curved surface defining a pointed apex;

a pressure differential microphone mounted near the sound opening and having one side facing the apex and another side opposing the apex.

* * * * *